United States Patent [19]

Crosby et al.

[11] 3,971,082

[45] July 27, 1976

[54] SPRING ATTACHMENT ASSEMBLIES

[75] Inventors: Lawton H. Crosby, Lake Bluff, Ill.; Thomas H. Keane, Morristown, Tenn.

[73] Assignee: Morley Furniture Spring Corporation, Chicago, Ill.

[22] Filed: Aug. 28, 1974

[21] Appl. No.: 501,155

[52] U.S. Cl. ..... 5/260; 267/110; 267/112

[51] Int. Cl.[2] ..... F16F 3/00; A61J 19/00

[58] Field of Search ..... 5/255, 259, 261–263, 5/351; 248/223; 267/102, 104, 107–110

[56] References Cited

UNITED STATES PATENTS

| | | | |
|---|---|---|---|
| 2,007,385 | 7/1935 | Stackhouse | 267/112 |
| 2,685,328 | 8/1954 | Hopkes, Jr. | 5/266 |
| 3,308,487 | 3/1967 | Birgbauer | 5/260 |
| 3,628,780 | 12/1971 | Saito | 267/110 |
| 3,667,749 | 6/1972 | Platt et al. | 267/112 |

*Primary Examiner*—Casmir A. Nunberg
*Assistant Examiner*—Victor N. Sakran
*Attorney, Agent, or Firm*—Hume, Clement, Brinks, Willian, Olds & Cook, Ltd.

[57] ABSTRACT

A rail attachment assembly for attaching an end of a sinuous spring band to a steel rail. A vertical or a horizontal flange of the rail is apertured or cut-out to facilitate passage of an anchor link or band element. The aperture or cut-out is elongated along one axis to permit pivotal movement of the link or band through a substantial arc without interference.

4 Claims, 11 Drawing Figures

SPRING ATTACHMENT ASSEMBLIES

FIELD OF THE INVENTION

This invention is in the field of furniture springs and the like. It particularly relates to attachment assemblies for attaching sinuous springs to steel rails in a furniture frame or the like.

BACKGROUND OF THE INVENTION

Sinuous springs have been widely used in the furniture spring industry for a long time. They were originally developed to provide a spring seat that was substantially less expensive than the traditional coil springs but provided a satisfactory comfort rating. Nevertheless, until recently no one has disputed the fact that coil springs did provide a much more luxurious seat.

In the last 10 years, developments of Lawton H. Crosby related to sinuous springs have greatly improved the results obtained with sinuous springs. As a result, many more are being used. Conventionally, such spring assemblies comprise wood rail frames with a plurality of sinuous spring bands stretched between them. An alternative is the steel rail construction wherein steel channels, angle irons, or plain bars replace the wooden rails. The present invention is concerned with rail attachment assemblies for attaching sinuous spring bands to steel rails.

SUMMARY OF THE INVENTION

An object of the present invention is to provide improved rail attachment assemblies for sinuous spring bands. Another object is to provide improved rail attachment assemblies for attaching sinuous spring bands to steel frame rails. Another object is to provide attachment assemblies which provides greatly enhanced versatility in steel rail attachments. Yet another object is to provide a rail attachment assembly which permits simple pivot mounting of a sinuous spring band to the rail, or, in the alternative, more sophisticated translatory mounting. A further object is to provide attachment assemblies which greatly lower installation costs. Still a further object is to provide attachment assemblies which assure virtually noiseless operations.

BRIEF DESCRIPTION OF THE DRAWINGS

The invention, including its construction and method of operation, together with additional objects and advantages thereof, is illustrated more or less diagrammatically in the drawing, in which.

DESCRIPTION OF THE PREFERRED EMBODIMENTS

Figure 1:
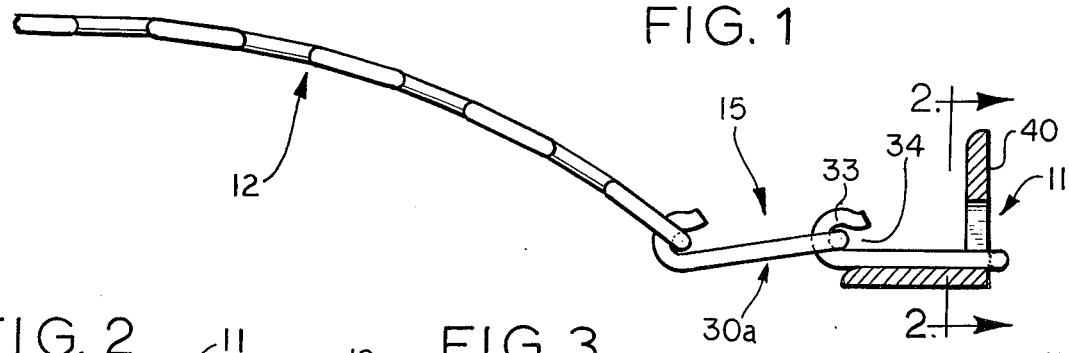
FIG. 1 is a sectional view taken through the back rail of a steel frame and spring assembly and illustrating a first form of rail attachment assembly embodying features of the present invention.
Figure 2:
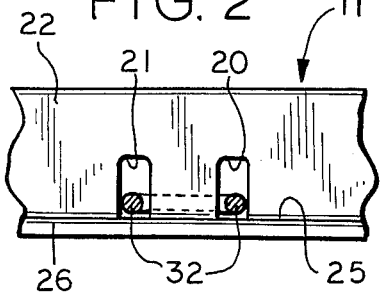
FIG. 2 is a sectional view taken along line 2—2 of FIG. 1.
Figure 3:
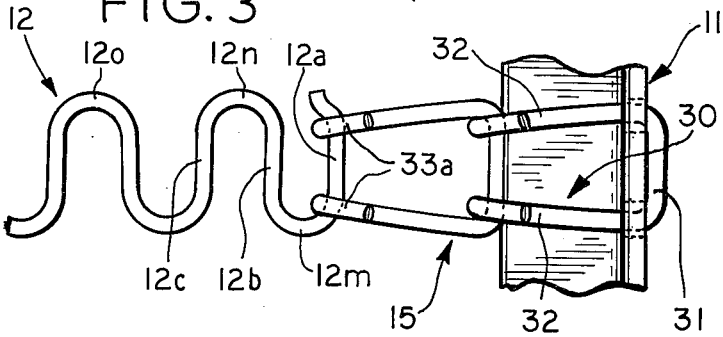
FIG. 3 is a top plan view of the attachment assembly illustrated in FIG. 1.

Referring now to the drawings, and particularly to FIGS. 1–3, a portion of a steel furniture frame unit is seen generally at 10. The frame unit 10 includes a back rail 11 which is fabricated from a steel angle iron and is illustrated in transverse section. A plurality of conventional sinuous spring bands 12 are connected to the back frame rail 11 by a first form of an attachment assembly embodying features of the present invention and seen generally at 15. It will be understood, of course, that FIG. 1 illustrates a single sinuous spring band 12 and attachment assembly 15 connecting the band to the rail 11, whereas a frame unit 10 would actually comprise a series of these bands in spaced, parallel relationship.

The attachment assembly 15 includes a pair of vertically elongated apertures 20 and 21 formed in the vertical flange 22 of the angle iron rail 11. The vertically elongated apertures 20 and 21 are formed upwardly from the upper surface 25 of the horizontal flange 26 in the rail in the manner best illustrated in FIGS. 1 and 2.

The horizontal spacing of the apertures 20 and 21 is determined by the dimensions of an anchor link 30 which forms a component of the attachment assembly 15. The anchor link 30 is fabricated from heavy steel wire and includes a base leg 31 from which attachment legs 32 extend in converging relationship, as illustrated in FIG. 3. Formed on the free end of each leg 32 is an attachment clip 33 having an open mouth 34 facing the base leg 31.

It is the length of the base leg 31 which determines the horizontal spacing of the vertically elongated apertures 20 and 21. The apertures 20 and 21 are so spaced that when the legs 32 of the anchor link 30 are drawn apart, into parallel relationship, the attachment clips 33 can be inserted through the apertures 20 and 21 from the back of the vertical flange 22 on the rail 11 and the anchor link moved forwardly until the base leg 31 engages the back surface 40 of the vertical flange. The legs 32 are then allowed to spring back into converging relationship and, in this position, the base leg 31 of the anchor link 30 seats flat against the back surface 40 of the vertical flange 22.

The vertical apertures 20 and 21 are wider than the diameter of the attachment legs 32 so that the anchor link 30 can pivot upwardly and downwardly on the flange surface 40 without binding against the inner surfaces of the apertures 20 and 21.

In the attachment assembly 15 another anchor link **30*a*, identical to the anchor link 30, is seated in the free end clips 33 of the anchor link 30. The anchor link 30*a* is identical in all respects to the anchor link 30** and, accordingly, corresponding components are identified by corresponding reference numerals with the additional of the suffix *a*.

As is conventional, it will be seen that the sinuous spring band 12 comprises a series of substantially parallel, linear segments 12*a*, 12*b*, 12*c*, etc., interconnected by alternating, generally semi-circular segments 12*m*, 12*n* and 12*o*, etc. The end-most linear segment 12*a* is seated in the clip 33*a* of the anchor link 30*a* in a manner discussed in detail in applicant's U.S. Pat. No. 3,790,149, issued Feb. 5, 1974 and entitled Spring Construction.

The attachment assembly 15 provides self-locking of the links 30 when they are seated in the aforedescribed manner. They cannot inadvertently pop-out prior to assembly of the frame unit 10. The ease of mounting of the links results in savings in labor costs.

An additional advantage of the invention is that the link base leg 31 pivots on a flat surface. As a result, its movement is virtually noiseless. Similarly, the legs 32 of the link move noiselessly up and down since they don't bind in the apertures 20 and 21.

The attachment assembly 15 which has been described as a first form of the present invention utilizes two anchor links 30 and 30*a* in series relationship. This affords pivoting of the outer anchor link 30*a* and, at the same time, vertical translatory movement of the free end of the sinuous spring band 12.

Where only pivotal action of the free end of the spring band 12 is desired, however, dependent upon the seating used in the unit 10, the end linear segment 12*a* of the band 12 can be seated directly in the clip 33 of the swing anchor 30. This eliminates the second anchor link 30*a*, of course. The length of the anchor link 30 is established so that free pivoting of either the anchor link 30*a* or the end of the spring band 12 is afforded, as best illustrated in FIG. 1.

Figure 4:
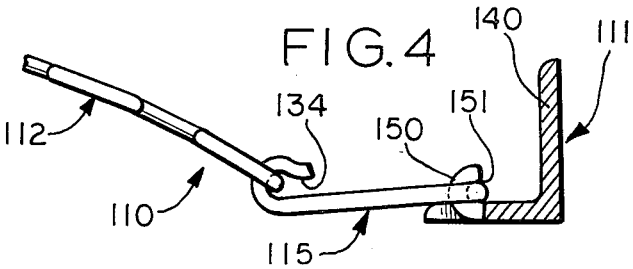
FIG. 4 is a view similar to FIG. 1 illustrating a second form of rail attachment assembly embodying features of the present invention.
Figure 5:
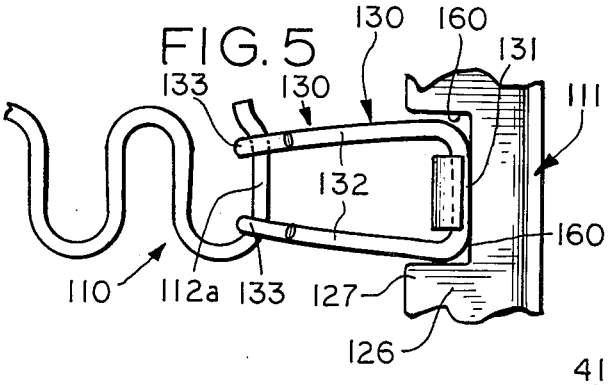
FIG. 5 is a top plan view of the rail attachment assembly illustrated in FIG. 4.

Turning now to FIGS. 4 and 5, a portion of another steel furniture frame unit is seen generally at 110. The unit 110 also includes a back rail 111 fabricated of an angle iron and a sinuous spring band 112 of conventional construction. They are interconnected by an attachment assembly 115 embodying features of a second form of the present invention.

The attachment assembly 115 requires only a single anchor link 130 to provide attachment and vertical translatory movement of the free end of the spring band 112. This is achieved by providing a new and improved means of pivotally mounting the anchor link 130 adjacent the front edge 127 of the horizontal flange 126 of the horizontal flange 126 in the angle iron rail 111.

As best seen in FIG. 5, an upwardly and outwardly curved clip 150 is formed from the horizontal flange 126. The clip 150 defines an open mouth 151 facing toward the vertical flange 140 of the angle iron rail 111. It is into this open mouth 151 that the base leg 131 of the anchor link 130 is seated.

As will now be understood, an anchor link 130 includes attachment legs 132 extending away from the base leg 131, converging toward each other to terminate in attachment clips 133 in which the free end linear segment 112*a* of the sinuous spring band 112 is seated.

The width (i.e., dimension lengthwise of the rail 111) of the clip 150, as seen in FIG. 5, is established so that it is approximately one-eighth inch less than the distance between the attachment legs 132 of the anchor link 130 at the point where they join the base leg 131. As a result, the anchor link 130 can pivot freely without binding on the curved inner surface 155 of the clip 150, which has a larger radius than the radius of the wire making up the clip 130 itself. Nevertheless, because of the remaining one-sixteenth inch spacing on each end of the clip 150 the anchor link 130 cannot move transversely of the clip 150.

Bracketing the clip 150 are cut-outs 160 formed rearwardly of the front edge 127 in the flange 126. The cut-outs 160 are sufficiently wide, as seen in FIG. 5, to permit the anchor link 130 to pivot on the surface 155 within the clip 150 through an arc exceeding 180°.

The attachment assembly 115 affords substantially the same advantages previously discussed in relation to the attachment assembly 15. Noiseless operation, ease of mounting of the link 130 in the clip 150, and decreased labor costs result. As will be seen, the band 112 can be seated directly in the clip 150 also.

The attachment assemblies 15 and 115 hereinbefore described are designed primarily for use on furniture frame back rails. Other forms of attachment assemblies embodying features of the invention find particularly advantageous application on furniture frame front rails, however.

Figure 6:
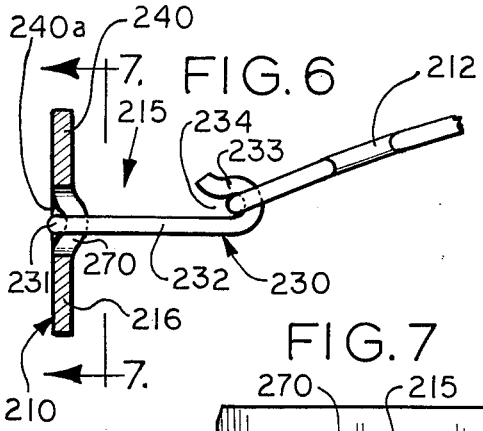
FIG. 6 is a sectional view taken through a front rail of a steel frame illustrating a third form of rail attachment assembly embodying features of the present invention.
Figure 7:
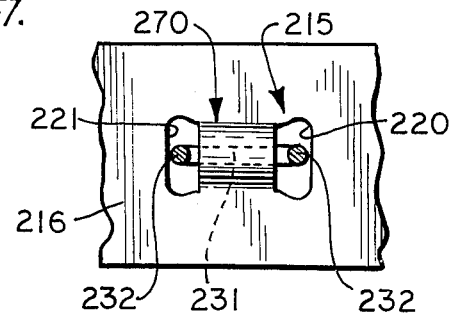
FIG. 7 is a sectional view taken along line 7—7 of FIG. 6.

Attention is directed first to FIGS. 6 and 7 where a portion of a steel furniture frame unit is seen generally at 210. The frame unit 210 includes a front rail 216 which is fabricated from a steel bar and is illustrated in transverse section. A plurality of conventional sinuous spring bands 212 are connected to the front frame rail 216 by a third form of attachment assembly embodying features of the present invention and seen generally at 215.

The attachment assembly 215 includes a pair of vertically elongated apertures 220 and 221 formed in the vertical bar rail 211. The vertically elongated apertures 220 and 221 are horizontally spaced by a dimension determined by the dimensions of an anchor link 230 which forms a component of the attachment assembly 215.

The anchor link 230 is fabricated of heavy steel wire and includes a base leg 231 from which attachment legs 232 extend in converging relationship, similar to the links 30 and 130 hereinbefore described. Formed on the free end of each leg 232 is an attachment clip 233 having an open mouth 234 facing the base leg 231.

Again, it is the length of the base leg 231 which determines the horizontal spacing of the vertically elongated apertures 220 and 221. The apertures 220 and 221 are so spaced that when the legs 232 of the anchor link 230 are drawn apart, into parallel relationship, the attachment clips 233 can be inserted through the apertures 220 and 221 from the front of the vertical bar rail 211 and the anchor link moved rearwardly until the base leg 231 engages the front surface 240 of the vertical bar rail. The legs 232 are then allowed to spring back into converging relationship so as to lock the link 230 on the rail 211.

In the attachment assembly 215, the segment 270 of the vertical steel bar which forms the rail 211 and is disposed directly between the two apertures 220 and 221 is formed inwardly by suitable forming means so it has a uniform cross-section such as illustrated in FIG. 6. This inward forming of the segment 270 of the bar 211 creates an arcuate front surface section 240*a* against which the base leg 241 of the link 230 bears. The bar segment 270 is formed inwardly to an extent that when the base leg 231 is seated against the surface section 240*a* it lies substantially in the plane of the bar.

The vertical apertures 220 and 221 are wider than the diameter of the attachment legs 232 so that the anchor link 230 can pivot upwardly and downwardly on the surface 240*a* without binding against the inner surfaces of the apertures 220 and 221. Because of its positioning substantially in the plane of the bar 211, the pivoting of the base leg 231 on the surface 240*a* actually permits the link 230 to pivot through an arc in excess of approximately 120°.

The front end of the sinuous spring band 212 is seated in the clips 233 of the attachment legs 232 in the anchor link 230. This mounting arrangement has hereinbefore been sufficiently discussed to obviate the necessity of further explanation.

The advantages of the attachment assembly 210 should now be recognized. The link 230 locks itself in place. It is easily and quickly mounted and pivots noiselessly during operation. It provides substantially the same advantages as other forms of the invention.

Referring now to FIGS. 8–11, two additional attachment assemblies 315 and 415 embodying fourth and fifth forms of the invention are illustrated. The attachment assembly 315 seen in FIGS. 8 and 9 and the attachment assembly 415 seen in FIGS. 10 and 11, also find particularly advantageous application on furniture frame front rails. Each is designed to connect a sinuous spring band (312 or 412) directly to the front rail (311 or 411) of a frame until (310 or 410).

Figure 8:
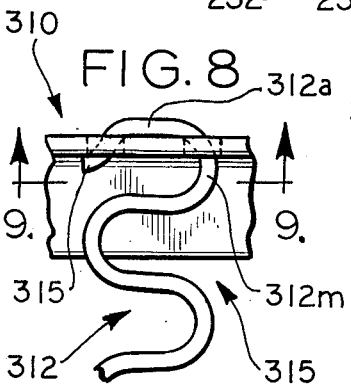
FIG. 8 is a top plan view of a front rail in a steel frame illustrating a fourth form of rail attachment assembly embodying features of the present invention.
Figure 9:
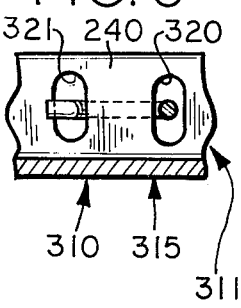
FIG. 9 is a sectional view taken along line 9—9 of FIG. 8.

Referring to FIGS. 8 and 9, the rail 311 will be seen to be an angle iron similar to the angle iron described in relation to the attachment assembly 11. In the angle iron 311, however, vertically elongated apertures 320 and 321 identical to the apertures 220 and 221 hereinbefore described in relationship to the attachment assembly 215 are provided in the vertical flange 240 of the angle iron.

The sinuous spring band 312 is locked into the apertures 320 and 321 in the manner illustrated. As is conventional the sinuous band 312 includes a series of linear segments 312*a* and 312*b*, 312*c*, etc., interconnected by a series of generally semi-circular segments 312*m*, 312*n*, and 312*o*, etc. The free end of the endmost linear segment 312*a* has a conventional tail 315 formed on it.

To attach the band 312 to the rail 311, the tail 315 is first inserted through the vertically elongated apertures 220. Then the linear segment 312*a* and a substantial portion of the semi-circular segment 312*m* are threaded through the aperture 320. This places the linear segment 312*a* at an angle to the back surface of the vertical flange. In this relationship, the tail 315 can be inserted through the aperture 321 from the back to the front of the flange.

To lock the sinuous band 312 into the rail 311, the band is merely pulled forwardly once the tail 315 has passed through the aperture 321. When the linear segment 312*a* seats flush against the back surface of the flange in the manner illustrated in FIG. 8, the band in locked in position. In this operational position, it can pivot vertically without interference and substantially noiselessly. Furthermore, it is locked in place.

Figure 10:
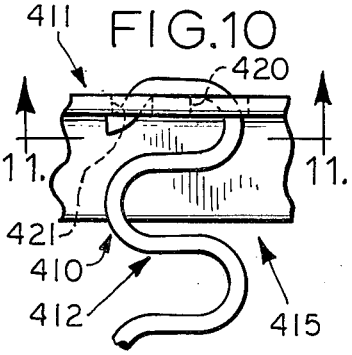
FIG. 10 is a view similar to FIG. 8 illustrating still a fifth form of rail attachment assembly embodying features of the present invention.
Figure 11:
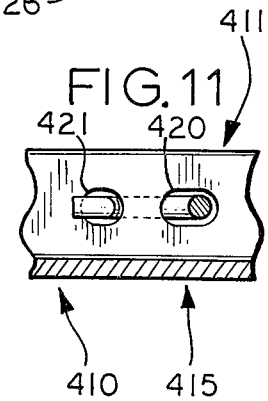
FIG. 11 is a sectional view taken along line 11—11 of FIG. 10.

Finally, referring to FIGS. 10 and 11, the fifth form of attachment assembly 415 embodying features of the present invention is quite similar to the fourth form 315. The apertures 420 and 421 are elongated horizontally, however, to a greater extent than they are vertically. They are substantially wider vertically than the thickness of the wire, however, so that the sinuous spring band 412 can pivot upwardly and downwardly through a reasonable angle without interference.

The aperture 420 is elongated transversely. Its length is approximately five times the diameter of the wire. The length of the aperture 421 is, on the other hand, approximately three times the diameter of the wire. This permits the wire to be threaded through to the apertures 420 and 421 in the manner hereinbefore discussed in relation to the attachment assembly 315 and obtain a locking of the sinuous spring band 412 in the flange when the band is drawn into the position seen in FIG. 10.

Ease of locking attachment of the sinuous spring band 412 to the flange 411 is facilitated, as will be seen. A great saving in labor and thus cost is afforded.

While several embodiments described herein are at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. An attachment assembly for attaching a sinuous spring band to a steel rail in a furniture frame or the like wherein the rail comprises a horizontal flange and a vertical flange, comprising:

a. a pair of openings formed in said vertical flange in spaced relationship along the length of the flange, b. each of said openings comprising a vertically elongated aperture formed through said vertical flange immediately adjacent said horizontal flange, c. a generally u-shaped anchor link having a base leg seated against the back surface of said vertical flange and a pair of attachment legs extending through said vertically elongated apertures and normally resting on said upper surface of said horizontal flange, d. the free ends of said attachment legs each having an attachment clip formed thereon substantially in alignment with the free edge of the horizontal flange whereby one of a link member and a sinuous spring band segment may be seated in said attachment clips and free to pivot about a pivot axis defined by said attachment clips.

2. The attachment assembly of claim 1 further characterized in that:

a. said link member has a base leg seated in the attachment clips of said u-shaped anchor link.

b. said link member having attachment legs and attachment clips formed on the free ends thereof.

c. the free end segment of said sinuous spring band being seated in the attachment clips on the free ends of said link member.

3. An attachment assembly for attaching a sinuous spring band to a steel rail in a furniture frame or the like wherein the rail comprises a horizontal flange and a vertical flange, comprising:

a. a pair of openings comprising cut-outs formed outwardly of the free end in said horizontal flange, b. said cut-outs bracketing an upwardly and outwardly turned attachment clips formed from the flange between the cut-outs, c. an attachment means being seated in said clips and adapted for vertical movement through said cut-outs without interference from said horizontal flange, d. said attachment means comprising a generally u-shaped anchor link having a base leg seated in said clip and a pair of attachment legs extending generally horizontally therefrom, e. attachment clips formed on the free ends of said attachment legs and the free end of a sinuous spring band being seated in the attachment clips of the attachment legs.

4. An attachment assembly for attaching a sinuous spring band to a steel rail in a furniture frame or the like wherein the rail comprises at least a vertical flange, comprising:

a. a pair of openings formed in said vertical flange in spaced relationship along the length of said flange, b. said openings comprising a pair of vertically elongated apertures, c. attachment means extending through both of said openings and connecting one end of the band to said vertical flange, d. said attachment means including a generally u-shaped anchor link having a base leg seated against the back surface of said vertical flange and a pair of attachment legs extending through corresponding ones of said apertures, e. a segment of said vertical flange between said vertically elongated openings being formed inwardly of said flange so that when said base leg of said anchor link seats against the back surface of said flange it lies substantially in the plane of said flange.

* * * * *